US012679630B2

(12) United States Patent
Franzen

(10) Patent No.: US 12,679,630 B2
(45) Date of Patent: Jul. 14, 2026

(54) PACKAGE FOR COLLATING A PLURALITY OF SMOKING ARTICLES

(71) Applicant: JT International SA, Geneva (CH)

(72) Inventor: Jens Franzen, Gilly (CH)

(73) Assignee: JT International SA, Geneva (CH)

( * ) Notice: Subject to any disclaimer, the term of this patent is extended or adjusted under 35 U.S.C. 154(b) by 0 days.

(21) Appl. No.: 18/863,382

(22) PCT Filed: May 10, 2023

(86) PCT No.: PCT/EP2023/062495
§ 371 (c)(1),
(2) Date: Nov. 6, 2024

(87) PCT Pub. No.: WO2023/217903
PCT Pub. Date: Nov. 16, 2023

(65) Prior Publication Data

US 2025/0313401 A1 Oct. 9, 2025

(30) Foreign Application Priority Data

May 13, 2022 (EP) ..... 22173367
Feb. 22, 2023 (EP) ..... 23158060

(51) Int. Cl.
*B65D 85/10* (2006.01)

(52) U.S. Cl.
CPC ... *B65D 85/1027* (2013.01); *B65D 85/10564* (2020.05); *B65D 2565/387* (2013.01)

(58) Field of Classification Search
CPC ..... B65D 85/1045; B65D 85/1018; B65D 85/1027; B65D 85/10564; A24F 15/02; A24F 15/12; A24F 15/06; A24F 15/16
(Continued)

(56) References Cited

U.S. PATENT DOCUMENTS 2,342,240 A 2/1944 Bell
2,579,443 A * 12/1951 Snyder ..... B65D 75/68
229/87.05

(Continued)

FOREIGN PATENT DOCUMENTS

EP 3196148 A1 7/2017
JP H11189272 A 7/1999

(Continued)

OTHER PUBLICATIONS

English translation of WO2009148037 (Year: 2009).*
International Search Report for PCT/EP2023/062495 mailed Aug. 22, 2023. 7 pages.

*Primary Examiner* — Steven A. Reynolds
(74) *Attorney, Agent, or Firm* — Lerner David LLP

(57) ABSTRACT

A package for collating a plurality of smoking articles includes a substantially cuboidal pouch including: front and rear major portions, top and bottom minor portions, and first and second side portions. The pouch is formed from a wrapper folded and sealed by: first, second, and third fin seals extending along the length of the front major portion, the top minor portion, and the bottom minor portion, respectively. The first seal is folded to overlap with each of the second and third seals. The first seal is at a distance from each side portion such that, at each overlap with the second and third seals, the first seal only overlaps with two other layers of the wrapper. A tear tape is attached to the pouch and extends along the front and rear major portions and the first and second side portions. A line of weakening is parallel to the tear tape.

17 Claims, 9 Drawing Sheets

(58) Field of Classification Search
USPC ..... 206/264
See application file for complete search history.

(56) References Cited

U.S. PATENT DOCUMENTS

| | | | | |
|---|---|---|---|---|
| 8,757,371 | B2 * | 6/2014 | Draghetti | B65D 85/10564 206/268 |
| 2010/0276311 | A1 * | 11/2010 | Biondi | B65D 85/1009 206/249 |
| 2015/0001109 | A1 * | 1/2015 | Gibson | B65D 85/1027 229/87.13 |
| 2017/0283146 | A1 * | 10/2017 | Polikeit | B65D 85/10 |
| 2017/0341852 | A1 * | 11/2017 | Bray | B65D 85/1045 |
| 2023/0091096 | A1 * | 3/2023 | Onuma | C08J 7/042 206/242 |

FOREIGN PATENT DOCUMENTS

| | | | |
|---|---|---|---|
| JP | 2002347833 | A | 12/2002 |
| WO | 9742098 | A1 | 11/1997 |
| WO | 2009148037 | A1 | 12/2009 |
| WO | 2015132770 | A1 | 9/2015 |
| WO | 2021170730 | A1 | 9/2021 |
| WO | 2022023700 | A1 | 2/2022 |

* cited by examiner

PACKAGE FOR COLLATING A PLURALITY OF SMOKING ARTICLES

CROSS-REFERENCE TO RELATED APPLICATIONS

The present application is a national phase entry under 35 U.S.C. § 371 of International Application No. PCT/EP2023/062495, filed May 10, 2023, published in English, which claims priority to European Application No. 23158060.6 filed Feb. 22, 2023, and to European Application No. 22173367.8 filed May 13, 2022, the disclosures of which are incorporated herein by reference.

FIELD OF THE INVENTION

The invention relates to a package for collating a plurality of smoking articles, and a container comprising a package for collating a plurality of smoking articles.

BACKGROUND

Smoking articles, such as cigarettes, are often wrapped within a pouch which is sealed to prevent the ingress of moisture. The use of a sealed pouch increases the shelf-life of the smoking articles and ensures a high quality product is provided to consumers. Such pouches are generally housed within a further container, such as a hinged-lid box, which provides additional structural protection for the smoking articles contained within the pouch.

Accordingly, it is desirable to provide a pouch for smoking articles which is reliably sealed with respect to the external environment. It is further desirable to achieve this aim whilst minimising the bulkiness of the pouch and whilst also utilising environmentally friendly packaging materials.

An object of the present invention is to address one or more of these issues.

SUMMARY OF INVENTION

According to a first aspect of the invention, there is provided a package for collating a plurality of smoking articles, comprising: a substantially cuboidal pouch comprising: a front major portion; a rear major portion; a top minor portion; a bottom minor portion; a first side portion; and a second side portion, wherein the pouch is made from material configured and sealed to prevent the ingress of moisture into the pouch, wherein the pouch is formed from a wrapper that is folded and sealed by: a first fin seal extending along the length of the front major portion; a second fin seal extending along the length of the top minor portion; and a third fin seal extending along the length of the bottom minor portion, wherein the first fin seal is folded to overlap with each of the second fin seal and the third fin seal, and wherein the first fin seal is arranged at a distance from each side portion such that, at each overlap with the second fin seal and the third fin seal, the first fin seal only overlaps with two other layers of the wrapper; and a tear tape attached to the pouch and extending along the front major portion, the first side portion, the rear major portion, and the second side portion in a transverse direction with respect to the length of the pouch, wherein a line of weakening is formed in the pouch parallel to the tear tape such that the pouch may be at least partially opened along the line of weakening when the tear tape is pulled by a user.

Advantageously, using fin seals to seal the pouch ensures that smoking articles contained within the pouch are not compressed when the pouch is sealed along each fin seal. In contrast, the use of lap seals to seal the pouch would result in smoking articles contained within the pouch being compressed during sealing of the pouch along the lap seals. Moreover, by arranging the first fin seal at a distance from each side portion such that the first fin seal only overlaps with two other layers of wrapper at each overlap with the second and third fin seals, the seal quality at the second and third fin seals is significantly improved, and the bulkiness of the pouch is reduced. That is, in a cuboidal pouch, each of the second and third fins seals contain four layers of overlapping wrapper adjacent the side portions of the pouch, due to excess wrapper being tucked back into the second and third fin seals. In contrast, towards the centre of the second and third fin seals, each of the second and third fins seals are composed of only two layers of overlapping wrapper. Hence, by sizing and positioning the first fin seal to avoid overlap with the excess wrapper tucked into the second and third fin seals, the number of overlapping layers of the first and second fin seals, and the first and third fin seals, is minimised. This results in a higher quality seal and a less bulky pouch.

The skilled person will appreciate that the length of the pouch is the perpendicular distance between the top minor portion and the bottom minor portion. This may also be referred to as the height of the pouch.

Preferably, the tear tape is attached to the internal surface of the pouch and extends through the first fin seal to expose a tear tab to be pulled by a user. In this way, the tear tape is protected from the external environment by the pouch, and it is ensured that the pouch is torn open when the tear tape is pulled by a user.

In addition, by routing the tear tape through the first fin seal, the ease of manufacturability of the pouch is improved, and the bulkiness further decreased.

Preferably, the first fin seal is folded towards the first side portion, wherein the distance between the base of the first fin seal and the first side portion is equal to or greater than the sum of the width of the first fin seal and half the width of the first side portion, and wherein the distance between the base of the first fin seal and the second side portion is equal to or greater than half the width of the second side portion.

In this way, a particular arrangement is provided which ensures that, at each overlap with the second fin seal and the third fin seal, the first fin seal only overlaps with two other layers of the wrapper.

Preferably, the wrapper is a cellulose-based wrapper, and wherein the pouch further comprises a moisture barrier coating formed on the wrapper. In this way, the pouch is constructed from sustainable materials which are effective in sealing and protecting the smoking articles housed within the pouch from the external environment. Optionally, the pouch comprises (or consists of) the wrapper, the moisture barrier coating formed on the wrapper, and an outer coating formed on an opposite surface of the wrapper to the moisture barrier coating. The outer coating may increase one or more of the strength, thickness, density and opacity of the pouch.

For example, the wrapper may comprise (or consist of) paper, hemp, moulded cellulose pulp, virgin fibre pulp or tobacco dust with paper.

Preferably, the moisture barrier coating is a heat sealable coating (or a heat seal adhesive). The heat sealable coating (e.g. a thermoplastic film) is bonded to the wrapper by applying pressure and heating the coating. The moisture barrier coating may comprise one or more layers or films. Alternatively, the moisture barrier coating may be a water-based lacquer. In a less preferred option, the moisture barrier coating is hot melt adhesive, i.e. an adhesive that is applied in a molten state and forms a bond on cooling to the solid state.

Preferably, the moisture barrier coating also reduces or prevents the ingress (or transfer) of oxygen, air, flavourings, and/or menthol.

Preferably, the pouch (i.e. the wrapper and the moisture barrier coating) may have a water vapour transmission rate of 0-10 g/m$^2$/day (at 23° C., 50% RH) and an oxygen transmission rate of <10 ccm/m$^2$/day (at 23° C., 50% RH). In one embodiment, the pouch may have a water vapour transmission rate of 2-10 g/m$^2$/day (at 23° C., 50% RH).

Preferably, the thickness of the pouch (i.e. the wrapper, the moisture barrier coating, and optionally the outer coating) is 65 to 85 μm.

Preferably, the density of the pouch (i.e. the wrapper, the moisture barrier coating, and optionally the outer coating) is 50 to 92 grams per square metre, more preferably 50 to 85 gram per square metre.

In one example, the pouch may comprise the outer coating, the thickness of the pouch may be 75 μm, the density of the pouch may be 90 grams per square metre, and the mean water vapour transmission rate at 23° C., 50% RH may be <1 g/m$^2$/day. In another example, the pouch may not comprise the outer coating, the thickness of the pouch may be 67 μm, the density of the pouch may be 75 grams per square metre, and the mean water vapour transmission rate at 23° C., 50% RH may be <1 g/m$^2$/day. In another example, the pouch may not comprise the outer coating, the thickness of the pouch may be 65-85 μm, the density of the pouch may be 70 grams per square metre, and the mean water vapour transmission rate at 23° C., 50% RH may be <3 g/m$^2$/day. In another example, the pouch may not comprise the outer coating, the thickness of the pouch may be 82 μm, the density of the pouch may be 75 grams per square metre, and the mean water vapour transmission rate at 23° C., 50% RH may be <8 g/m$^2$/day.

Preferably, the line of weakening is formed in the external surface of the pouch, and wherein the moisture barrier coating is formed on the internal surface of the pouch. Preferably, the outer coating is formed on the external surface of the pouch.

The line of weakening may be substantially level with the bottom edge of the tear tape. Alternatively, the line of weakening may be up to 3 mm below the bottom edge of the tear tape.

Preferably, the line of weakening partially extends through the wrapper (and/or extends partially or entirely through the outer coating, if present). In this way, the line of weakening does not affect the seal of the pouch to the external environment. Preferably, the line of weakening extends through less than 80%, preferably less than 70%, more preferably less than 60% and more than 20%, preferably more than 30%, more preferably more than 40% of the the thickness of the wrapper.

Preferably, the line of weakening is a pre-cut line, e.g. made by laser scoring, mechanical indentation or mechanical scoring. For example, the line of weakening may cut partially through the wrapper without extending through the moisture barrier coating such as to form a kiss-cut line.

Preferably, the package further comprises a stiffening element disposed within the pouch and arranged to lie substantially flush against the internal surface of the pouch. In this way, as the stiffening element provides additional stiffness, a larger section of the pouch may be removed during opening whilst maintaining appropriate stiffness of the package.

Preferably, the stiffening element is a cellulose-based stiffening element. For example, the stiffening element may comprise (or consist of) paper, hemp, or moulded cellulose pulp.

Preferably, the stiffening element has a higher rigidity than the pouch. For example, the stiffening element may have a density of 130 to 200 grams per square metre.

Preferably, the stiffening element is a folded element having a front section, a first side section, and a second side section, wherein the front section, first side section, and second side section are arranged to interface with the front major portion, first side portion, and second side portion of the pouch respectively, and wherein the first and second side sections each have a length equal to the length of the pouch. More, preferably the stiffening element consists of the front section, the first side section, and the second side section. In this way, the weight of the package is reduced whilst maintaining high stiffness.

Preferably, the front section of the stiffening element has a cut-out in its top edge, and wherein the cut-out extends down to at least level with the line of weakening. In this way, the ease of access to the smoking articles is improved whilst maintaining high stiffness of the package.

Preferably, the cut-out extends a distance below the line of weakening. In this way, smoking articles may be removed from the pouch with greater ease.

Preferably, the cut-out has a width of at least 50% of the width of the front section. Preferably, the cut-out has a length of 10 to 20% of the length of the front section.

Preferably, the cut-out is centrally positioned along the top edge of the front section of the stiffening element.

Preferably, the tear tape comprises a cellulose-based or paper-based material. In this way, the environmental impact of the package is further reduced.

Preferably, the tear tape extends around substantially the entire pouch.

Preferably, the tear tape is located at a distance from the top minor portion of between 10 to 20% of the length of the pouch. In this way, when the pouch is opened via the tear tape, an optimal balance is provided between the opening area for smoking article access and the stiffness of the opened pouch.

Preferably, wherein the tear tape is attached to the pouch such that a single layer of the tear tape extends through the first fin seal. In this way, the bulkiness of the pouch is further reduced.

Preferably, the tear tape is configured to be pulled to separate a top section of the pouch from a bottom section of the pouch, wherein the top section of the pouch includes at least part of the top minor portion, the front major portion, the rear major portion, the first side portion, and the second side portion of the pouch, and wherein the bottom section of the pouch includes at least part of the bottom minor portion, the front major portion, the rear major portion, the first side portion, and the second side portion of the pouch.

Preferably, the pouch and/or stiffening element do not comprise plastic film or metal. In particular, the pouch and/or stiffening element are not made of a paper laminate comprising plastic film or metal.

According to a second aspect of the invention, there is provided a container for smoking articles, comprising: an outer casing having a lid movable between an open position and a closed position; and a package according to the first aspect, wherein the package is housed within the outer casing.

According to a third aspect of the invention, there is provided a system comprising: a package according to the first aspect or a smoking article container according to the second aspect; and a plurality of smoking articles contained within the pouch.

BRIEF DESCRIPTION OF DRAWINGS

Embodiments of the invention are now described, by way of example, with reference to the drawings, in which.

DETAILED DESCRIPTION

Figure 1A:
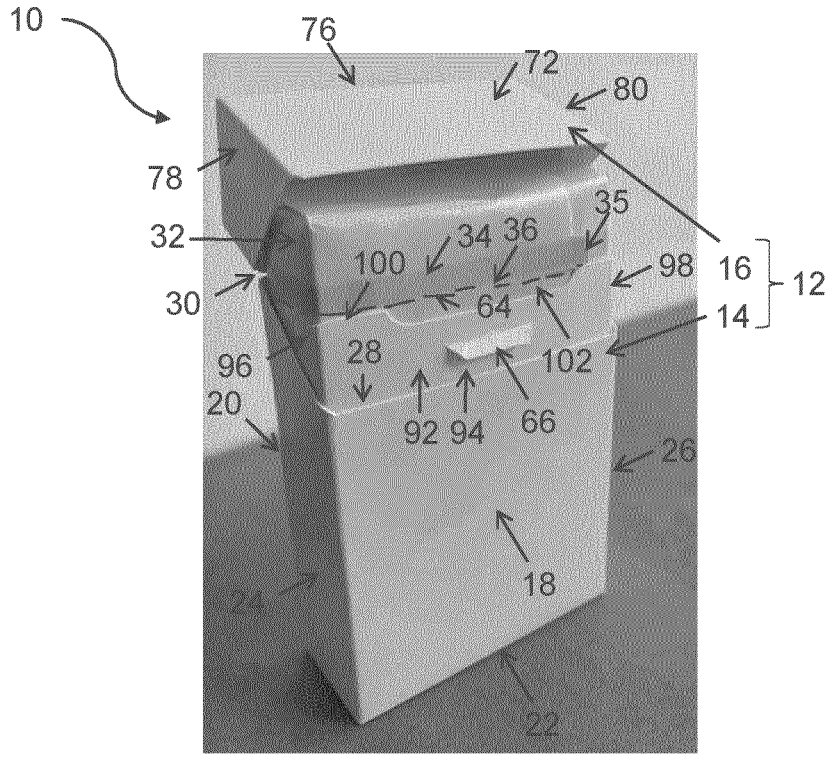
FIG. 1A is a perspective view of a container for smoking articles including a pouch and a lid in an open position.
Figure 1B:
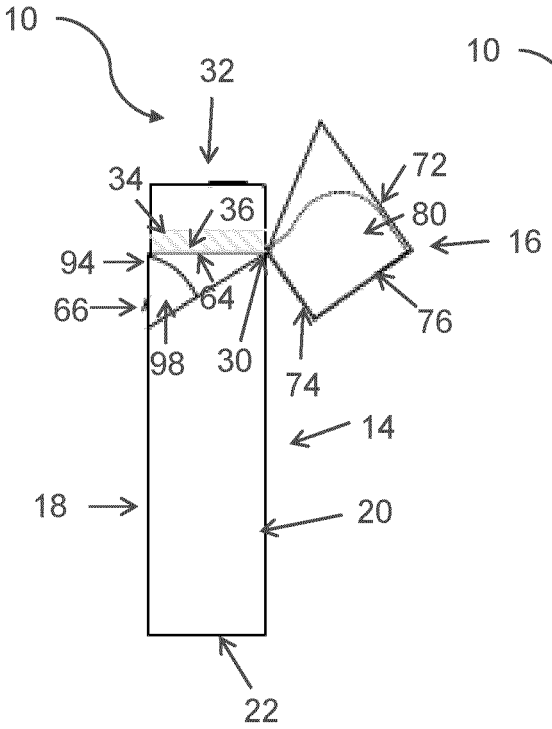
FIG. 1B is a schematic side view of the container including the pouch and the lid in the open position.
Figure 1C:
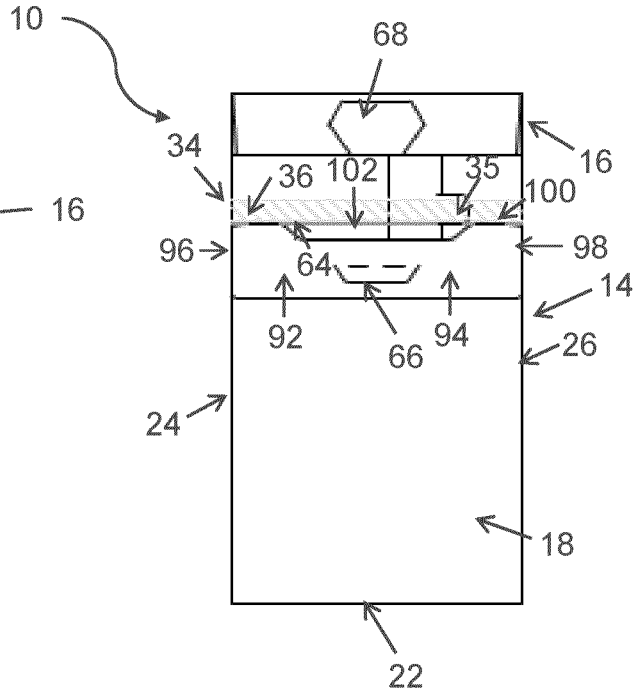
FIG. 1C is a schematic front view of the container including the pouch and the lid in the open position.
Figure 2A:
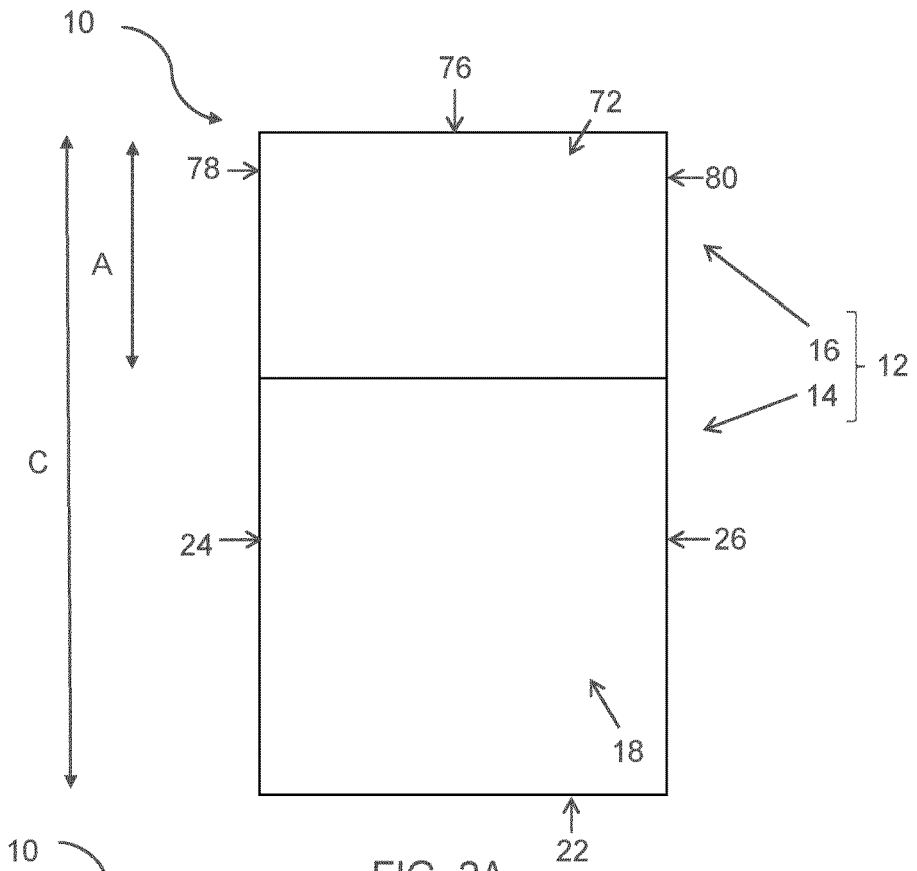
FIG. 2A is a schematic front view of the container including the pouch and the lid in a closed position.
Figure 2B:
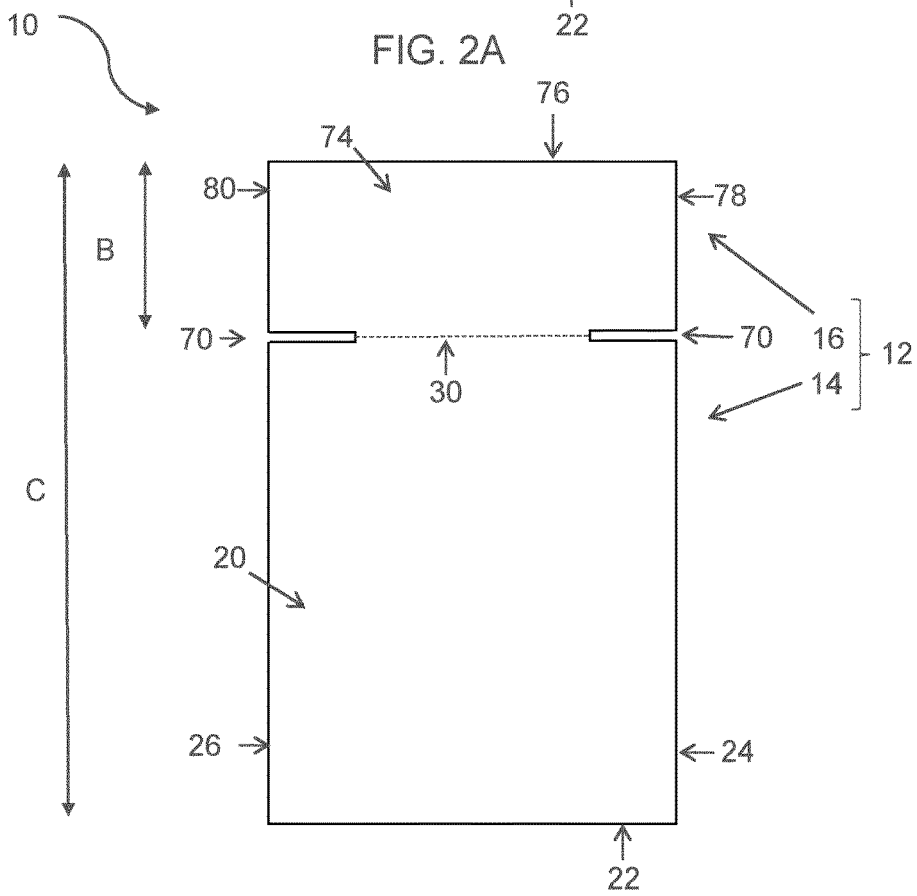
FIG. 2B is a schematic rear view of the container including the pouch and the lid in the closed position.

FIGS. 1A-1C and 2A-2B illustrate various views of a container 10 for smoking articles 8 in accordance with the present invention. The container 10 comprises an outer casing 12 which includes a main body 14 and a lid 16. The lid 16 is hingedly connected to the main body 14 by a hinge 30 such that the lid 16 may be moved between an open position and a closed position. FIGS. 1A-1C show the lid 16 in the closed position, whereas FIGS. 2A-2B show the lid 16 in the open position. In the open position, the contents housed within the outer casing 12 may be accessed by a user. In the closed position, the contents of the outer casing 12 are not accessible and the main body 14 and the lid 16 cooperatively define a cuboidal box. The skilled person will appreciate the container 10, or outer casing 12, may also be referred to as a hinged-lid box.

The main body 14 comprises a plurality panels 18-26 including a front panel 18, a rear panel 20, a bottom panel 22, a first side panel 24 (i.e. left side panel), and a second side panel 26 (i.e. right side panel). These panels 18-26 cooperatively define a main compartment having an opening 28 opposite to the bottom panel 22. The height of the rear panel 20 is greater than the height of the front panel 18 such that the first side panel 24 and the second side panel 26 increase in height towards the rear panel 20.

The lid 16 comprises a plurality of panels 72-80 including a front panel 72, a rear panel 74, a top panel 76, a first side panel 78 (e.g. a left side panel), and a second side panel 80 (e.g. a right side panel). These panels 72-80 cooperatively define a secondary compartment having an opening opposite to the top panel 76. The height of the front panel 72 is greater than the height of the rear panel 74 such that the first side panel 78 and the second side panel 80 increase in height towards the rear panel 74.

The lid 16 is connected to the main body 14 by the hinge 30 which is positioned between the rear panel 74 of the lid 16 and the rear panel 20 of the main body 14. The skilled person will appreciate that the hinge 30 is not a separable component of the container 10, but instead is a connecting portion between the rear panel 74 of the lid 16 and the rear panel 20 of the main body 14 about which the lid 16 may be pivoted. That is, the hinge 30 may be described as a fold line or a crease line in the outer casing 12 which is formed from the same material as the main body 14 and the lid 16.

The outer casing 12 may be made of a cellulose-based material. For example, the outer casing 12 may comprise (or consists of) paper, hemp, or moulded cellulose pulp.

The outer casing 12 is configured such that the ratio of the height A of the front panel 72 of the lid 16 to the height B of the rear panel 74 of the lid 16 is between 1.8 and 2.2. For example, the ratio A/B may be 2. Advantageously, this size ratio optimises the accessibility of the pouch 32, and provides a larger opening area through which the contents of the outer casing 12 may be accessed, whilst ensuring the lid is not blocked from moving into the closed position. For example, if the height B of the rear panel 74 of the lid 16 is too large, the lid 16 is prevented from opening or closing, but if the height B of the rear panel 74 of the lid 16 is too small, it has been found that the lid may not close properly after multiple openings, and the lid is more likely to be separated from the main body. Moreover, a larger height A of the front panel 72 of the lid 16 provides a larger area for accessing the smoking articles, but a smaller height A of the front panel 72 of the lid 16 reduces the angle about which the lid 16 is required to be pivot in order to open the packet 10.

The outer casing 12 is further configured such that the ratio of the height B of the rear panel 74 of the lid 16 to the height C of the outer casing 12 when the lid 16 is in the closed position is between 0.15 and 0.19. For example, the ratio B/C may be 0.18. Additionally, the outer casing 12 is configured such that the ratio of the height B of the rear panel 74 of the lid 16 to the width D of the top panel 76 of the lid 16 is between 0.29 and 0.71. For example, the ratio B/D may be 0.67. These ratios further optimise the accessibility of the packet 10. The skilled person will understand that the width of the top panel is the distance between the front panel and the rear panel of the lid.

A pouch 32 is housed within the outer casing 12. Specifically, the pouch 32 is received within the main compartment of the main body 14 such that a portion of the pouch 32 protrudes through the opening 28 and is completely contained within the outer casing 12 when the lid 16 is moved into the closed position. The pouch 32 is sized to store and collate a plurality of smoking articles 8. That is, the height of the pouch 32 is substantially equal to the height of the smoking articles 8 such that the smoking articles 8 may be securely held within the pouch 32. In one example, the smoking articles 8 may be cigarettes. In other examples, the smoking articles 8 may be heat-not-burn sticks.

Figure 4A:
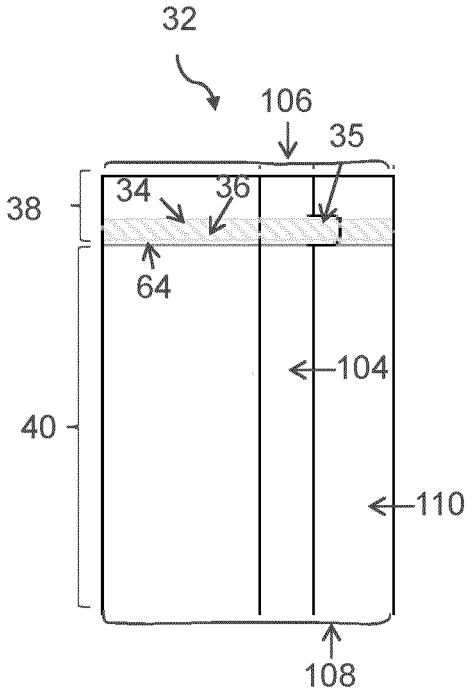
FIG. 4A is a schematic front view of the pouch in a closed state and sealed by a first fin seal, a second fin, and a third fin seal.
Figure 4B:
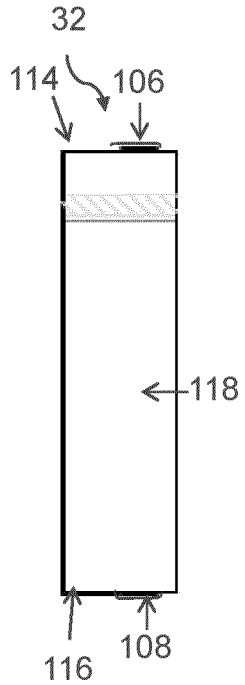
FIG. 4B is a schematic side view of the pouch in the closed state and sealed by the first fin seal, the second fin, and the third fin seal.
Figure 4C:
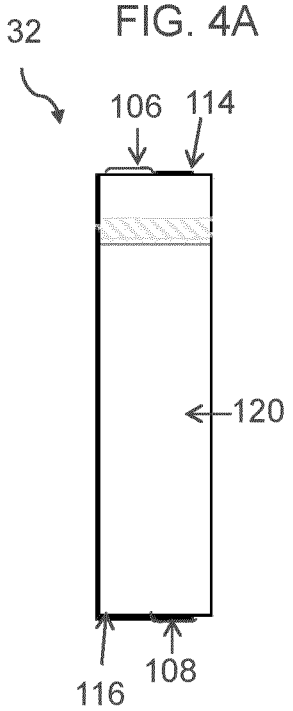
FIG. 4C is a schematic side view of the pouch in the closed state and sealed by the first fin seal, the second fin, and the third fin seal.
Figure 4D:
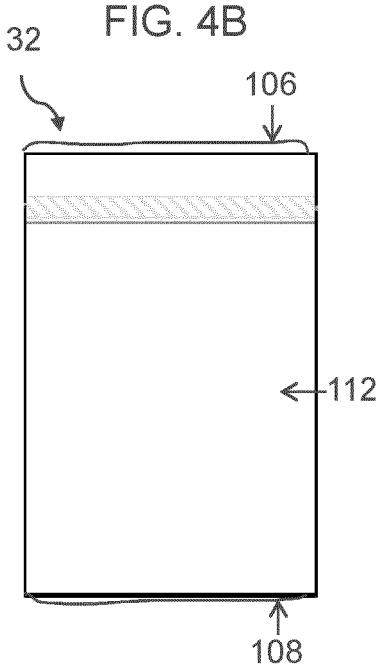
FIG. 4D is a schematic rear view of the pouch in the closed state and sealed by the first fin seal, the second fin, and the third fin seal.

The pouch 32 is substantially cuboidal and includes a front major portion 110, a rear major portion 112, a top minor portion 114, a bottom minor portion 116, a first side portion 118 (e.g. a left side portion), and a second side portion 120 (e.g. a right side portion). The pouch 32 is illustrated in further detail in FIGS. 4A-4C. FIG. 4A shows a schematic view of the front major portion 110 of the pouch 32, FIG. 4B shows a schematic view of the first side portion 118 of the pouch 32, FIG. 4C shows a schematic view of the second side portion 120, and FIG. 4D shows a schematic view of the rear major portion 112 of the pouch 32.

The pouch 32 comprises a wrapper 122 having a moisture barrier coating 124 formed thereon. Optionally, the wrapper 122 may also have an outer coating 125 formed on an opposite side of the wrapper 122 to the moisture barrier coating 124. The wrapper 122 is folded and sealed to form the substantially cuboidal pouch 32, having an exterior surface 126 and an interior surface 128. In particular, the pouch 32 is sealed by a first fin seal 104 extending along the length of the front major portion 110 of the pouch 32, a second fin seal 106 extending along the length of the top minor portion 114 of the pouch 32, and a third fin seal 108 extending along the length of the bottom minor portion of the pouch 32. The skilled person will understand that a fin seal is a seal formed by an edge portion of the interior surface 128 of the wrapper 122 being sealed to another edge portion of the interior surface 128 of the wrapper 122. In contrast, for example, a lap seal is formed by sealing an edge portion of the interior surface of the wrapper to an edge portion of the exterior surface of the wrapper. Advantageously, unlike lap seals, fin seals prevent the smoking articles 8 contained with the wrapper 122 from being compressed during sealing.

A tear tape 34 is attached to the pouch 32 and extends around the pouch 32. The tear tape 34 is attached to the interior surface 128 of the pouch 32 but, for illustrative purposes, is shown in FIGS. 4A-4C. The skilled person will appreciate that, in alternative embodiments, the tear tape 34 may be attached to the exterior surface 126 of the pouch 32.

The tear tape 34 (also known as a tear-off ribbon) is a strip of material which is adhesively coupled to the pouch 32. The tear tape may be pulled by a user to open the pouch 32. In particular, the tear tape 34 is stronger than the pouch 32 such that, when pulled, the pouch 32 is torn open along the length of the tear tape 34. The tear tape 34 may be made of (e.g. orientated) polymers, yarns, and filaments, but preferably is made of a cellulose-based material such as paper.

As illustrated, the tear tape 34 extends around substantially the entire circumference of the pouch 32 in a transverse direction. That is, the tear tape 34 extends around the front major portion 110, the first side portion 118, the rear major portion 112, and the second side portion 120 of the pouch 32 in a direction that is perpendicular to the length of the pouch 32. However, in alternative embodiments, the skilled person will appreciate that the tear tape 34 may only extend around a portion of the circumference of the pouch 32, e.g. at least 90% of the circumference of the pouch 32.

The tear tape 34 is arranged to extend through the first fin seal 104 of the front major portion 112 of the pouch 32, to expose a tear tab 35 of the tear tape 34 which may be pulled by a user. Advantageously, this increases the ease of manufacturability of the pouch 32. The tear tape 34 may be attached to the pouch 32 such that only a single layer of tear tape 34 protrudes through the first fin seal 104, thereby reducing the bulkiness of the pouch 32.

As best illustrated in FIGS. 1A and 1B, the bottom edge 36 of the tear tape 34 is aligned level with the hinge 30 of the outer casing 12. In other words, the tear tape 34 and the hinge 30 are arranged with respect to one another such that the bottom edge 36 of the tear tape 34 is positioned at substantially the same vertical height (i.e. at substantially the same position along the length of the container 10) as the hinge 30. The hinge 30, or top edge of the rear panel 20 of the main body 14, therefore lies in the same plane as the bottom edge 36 of the tear tape 34. In this way, when the lid 14 is in the open position, it is ensured that the tear tape 34 is not trapped between the pouch 32 and the main body 14 of the outer casing 12. Hence, the ease of removal of the tear tape 34, and thus opening of the pouch 32, is improved. Additionally, by located the bottom edge 36 of the tear tape 34 level with the hinge 30, as opposed to above the hinge 30, the hinge 30 (i.e. the top edge of the rear panel 20 of the main body 14) provides a guiding edge along which the tear tape 34 may be pulled. This further improves the ease of opening of the pouch 32 for a user.

Of course, the skilled person will appreciate that, in other embodiments, the bottom edge 36 of the tear tape 34 may not be positioned at the same level as the hinge 30. For example, the tear tape 34 may be positioned adjacent and above the hinge 30, e.g. the bottom edge of the tear tape may be positioned 0.5 mm, 1 mm, 1.5 mm, 2 mm, or 3 mm above the hinge, and/or the tear tape 34 may be positioned above the hinge 30 such that the distance between the bottom edge 36 of the tear tape 34 and the hinge 30 is less than the width of the tear tape 34. This arrangement similarly ensures that the tear tape 34 is accessible for users.

It is further preferable for the tear tape 34 to be arranged closer to the hinge 30 than the top minor portion 114 of the pouch 32. Advantageously, this configuration reduces the chance of the pouch 32 being ripped across the top minor portion 114, and instead promotes a clean partitioning of the pouch 32 around its circumference.

A line of weakening 64 is formed in the exterior surface 126 of the pouch 32. The line of weakening 64 enables the pouch 32 to be easily ripped along the line of weakening 64 when the tear tape 34 is pulled by a user. In one example, the line of weakening 64 may comprise a line of indentations, cuts, or scores. The line of weakened may be formed by laser scoring or mechanical cutting or indentation of the wrapper 122. The line of weakening 64 extends partially through the wrapper 122 (and/or extends partially or entirely through the outer coating 125, if present), and does not extend through the moisture barrier coating 124. This form of line of weakening may be referred to as a kiss-cut line. Advantageously, as the line of weakening 64 does not extend all the way through the pouch 32, the pouch 32 remains sealed to the external environment. In another example, the line of weakening 64 may comprise a chemically, radiatively, or mechanically weakened portion.

The line of weakening 64 is aligned adjacent with the bottom edge 36 of the tear tape 34 such that application of a pulling force to the tear tape 34 results in the pouch 32 being partitioned along the line of weakening 64. Specifically, the line of weakening 64 extends around the pouch 32, e.g. along the front major portion 110, the first side portion 118, the rear major portion 112, and the second side portion 120 of the pouch 32 in a direction that is perpendicular to the length of the pouch 32. Ideally, the line of weakening 64 is situated level with the bottom edge 34 of the tear tape 34 and/or the hinge 30. However, as illustrated in FIGS. 4A-4C, it is possible for the tear tape 34 to be slightly below the tear tape 34. In particular, the tear tape 34 may be up to 3 mm below the bottom edge 36 of the tear tape 34 whilst providing reliable opening of the pouch 32 along the line of weakening 64.

Figure 5A:
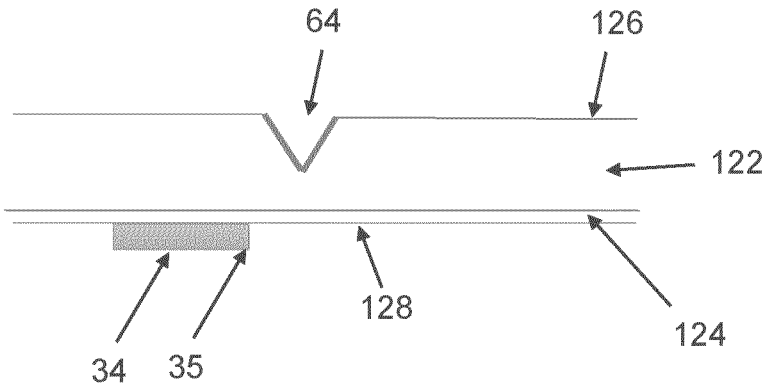
FIG. 5A is a cross sectional view of the pouch comprising a wrapper and a moisture barrier coating formed thereon.

FIG. 5A shows a cross-sectional view of the wrapper 122 and the moisture barrier coating 124 which form the pouch 32. As illustrated, the tear tape 34 is attached to the interior surface 128 of the pouch 32 and the line of weakening 64 is formed on the exterior surface 126 of the pouch. The moisture barrier coating 124 is formed on (or forms) the interior surface 128 of the pouch 32.

Figure 5B:
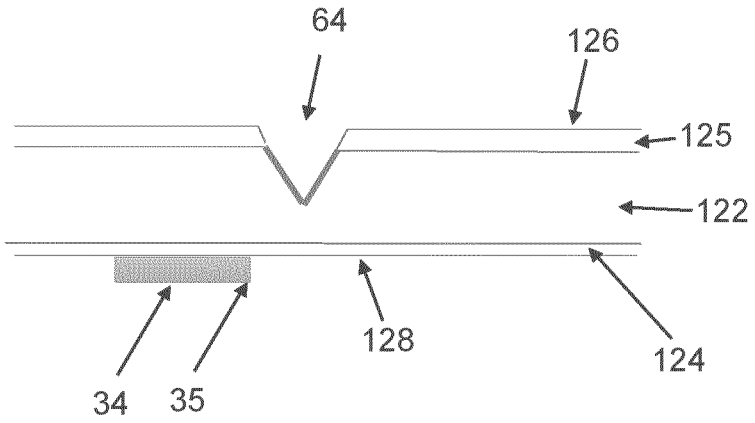
FIG. 5B is a cross sectional view of the pouch additionally comprising an outer coating.

FIG. 5B shows a cross-sectional view of the pouch 32 in an alternative embodiment, in which the pouch 32 further comprises the outer coating 125 formed on an opposite surface of the wrapper 122 to the moisture barrier coating 124. That is, the outer coating 125 is formed on (or forms) the exterior surface 126 of the pouch 32. The outer coating 125 may be configured to increase the tensile strength of the pouch 32 and/or alter the appearance of the pouch 32, such as increasing its opacity. In this example, the line of weakening 64 extends entirely through the outer coating 125 and partially through the wrapper 122. In alternative examples, the line of weakening may extend partially though the outer coating 125.

The thickness of the pouch 32 (i.e. the wrapper 122 and the moisture barrier coating 124 and optionally the outer coating 125) may be 65 to 85 microns. The density of the pouch 32 (i.e. the wrapper 122 and the moisture barrier coating 124 and optionally the outer coating 125) may be 50 to 92 grams per square metre. For example, the density of the pouch 32 may be 50 to 85 grams per square metre.

The wrapper 122 is made of a cellulose-based material, such as paper, hemp, moulded cellulose pulp, virgin fibre pulp or tobacco dust with paper. The moisture barrier coating 124 prevents the ingress of moisture through the wrapper 122, thereby protecting the smoking articles 8 contained within the pouch 32. Advantageously, by using a cellulose-based wrapper 122 with a moisture barrier coating 124, as opposed to a wrapper containing plastic or metal, the biodegradability and sustainability of the package 10 is improved without reducing the seal quality.

In one example, the moisture barrier coating 124 may be a heat sealable coating or film. In another example, the moisture barrier coating 124 may be a water-based lacquer. In another example, the moisture barrier coating 124 may be a hot melt adhesive.

The moisture barrier coating 124 may also reduce or prevent the transfer of oxygen, air, flavourings, and/or menthol through the pouch 32.

As a result of the fin sealing, and the properties of the moisture barrier coating 124, the pouch 32 (i.e. the wrapper 122, the moisture barrier coating 124, and optionally the outer coating 125) may have a water vapour transmission rate of 0-10 g/m$^2$/day (at 23° C., 50% RH) and an oxygen transmission rate of <10 ccm/m$^2$/day (at 23° C., 50% RH). For example, the pouch 32 may have a water vapour transmission rate of 2-10 g/m$^2$/day (at 23° C., 50% RH).

The wrapper 122, moisture barrier coating 124, and optionally the outer coating 125 (i.e. the blank 130 as discussed further below) may be manufactured using flexographic or gravure printing.

Exemplary material specifications for the pouch 32 are provided in the following table:

| Supplier | Material description | Basis weight (g/m$^2$) | Thickness (μm) | Mean water vapour transmission rate at 23° C., 50% RH (g/m$^2$ · day) |
|---|---|---|---|---|
| Sappi | Avantguard S Gloss | 90 | 75 | <1 |
| Sappi | Avantguard S Nature | 75 | 67 | <1 |
| Koehler | NexPlus Tobacco Flavor | 75 | 82 | <8 |

Figure 6:
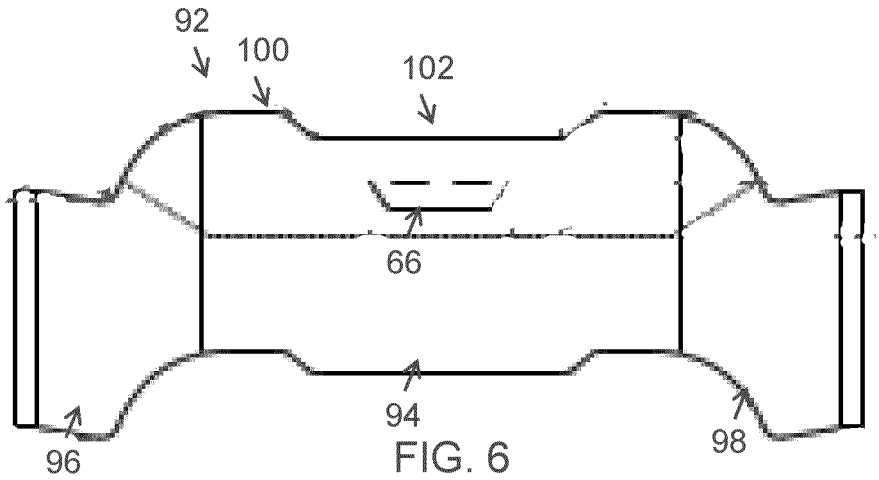
FIG. 6 is a schematic view of a frame of the container in unfolded form.

As seen in FIGS. 1A-1C, the container 10 further comprises a frame 92 (which may be referred to as an inner frame) which is located between the pouch 32 and the main body 14 of the outer casing 12. The frame 92 is a folded element including a front section 94, a first side section 96 (e.g. a left side section), and a second side section 98 (e.g. a right side section). FIG. 6 illustrates the frame 92 in unfolded form. The first side section 96 and the second side section 98 are connected to the opposing sides of the front section 94 by respective fold lines. When the container 10 is constructed, the first side section 96 and the second side section 98 are folded approximately 90 degrees about the respective fold lines and the frame 92 is arranged between the pouch 32 and the outer casing 12 such that the front section 94, the first side section 96 and the second side section 98 of the frame 92 are arranged adjacent to (i.e. interface with) each of the front panel 18 of the main body 14 and the front major section 110 of the pouch 32, each of the first side panel 24 of the main body 14 and the first side section 118 of the pouch 32, and each of the second side panel 26 of the main body 12 and the second side section 120 of the pouch 32 respectively.

Advantageously, the presence of the frame 92 improves the stiffness of the container 10, thereby providing enhanced protection and support of the smoking articles 8 contained with the pouch 32. Additionally, the frame 92 helps to ensure reliable closing of the lid 16, for example using the "click-lock" functionality described below.

As best illustrated in FIGS. 1A and 1B, the bottom edge 36 of the tear tape 34 is aligned level with the top edge 100 of the front portion 94 of the frame 92. In other words, the tear tape 34 and the frame 92 are arranged with respect to one another such that the bottom edge 36 of the tear tape 34 is positioned at substantially the same vertical height (i.e. at substantially the same position along the length of the container 10) as the top edge 100 of the front section 94 of the frame 92. The top edge 100 of the frame 92 therefore lies in the same plane as the bottom edge 36 of the tear tape 34. In this way, when the lid 16 is in the open position, it is ensured that the tear tape 34 is not trapped between the pouch 32 and the frame 92. Hence, the ease of removal of the tear tape 34, and thus opening of the pouch 32, is improved. Additionally, by locating the bottom edge 36 of the tear tape 34 substantially level with the top edge 100 of the frame 92, as opposed to above the top edge 100 of the frame 92, the top edge 100 of the frame 92 provides a further guiding edge along which the tear tape 34 may be pulled, which further improves the ease of opening of the pouch 32 for a user.

The skilled person will appreciate that as the hinge 30, the bottom edge 36 of the tear tape 34, and the top edge 100 of the frame 92 are all positioned in the same plane, the tear tape 34 may be reliably pulled around the entire circumference of the pouch 32 without obstruction.

Of course, the skilled person will also appreciate that, in alternative embodiments, the top edge 100 of the frame 92 may not be exactly level with the hinge 30 and/or the bottom edge 36 of the tear tape 34. In particular, it remains advantageous to arrange the frame 92 such that the top edge 100 of the frame 92 is below the tear tape 34, e.g. 0.5 mm, 1 mm, 1.5 mm or 2 mm below the bottom edge 36 of the tear tape 34, as this configuration also ensures that the tear tape 34 is not trapped between the pouch 32 and the frame 92.

A cut-out 102, which may also be referred to as a recessed portion, is formed in the top edge 100 of the front section 94 of the frame 92. The cut-out 102 is formed by removing a portion of material from the top edge 100 of the front section 94 of the frame 92. Preferably, the cut-out 102 extends a distance of up to 5 mm. For example, the cut-out 102 may extend 1 mm, 1.5 mm, 2 mm, 2.5 mm, or 3 mm below the top edge 100 of the frame 92.

The cut-out 102 is centrally positioned along the top edge 100 of the front section 94 of the frame 92, and preferably has a width of at least 50% of the width of the front section 94 of the frame 92.

Advantageously, the presence of the cut-out 102 improves the accessibility to the smoking articles 8 contained with the pouch 32 when the pouch 32 is opened, without adversely affecting the stiffening effect provided by the frame 92.

The front section 94 of the frame 92 further comprises a tongue 66, which may also be referred to as a tab, which is arranged to protrude away from the surface of the front section 94 of the frame 92. A complementary recess 68 is provided within the secondary compartment of the lid 16 on the front panel 72 of the lid 16. When the lid 16 is in the closed position, the tongue 66 is configured to engage with the recess 68 such that the lid 16 is held in the closed position. A threshold force applied by a user is required to disengage the tongue 66 from the recess 68 such that the lid 16 is moved into the open position. This may be referred to as a "click-lock" mechanism.

Figure 8:
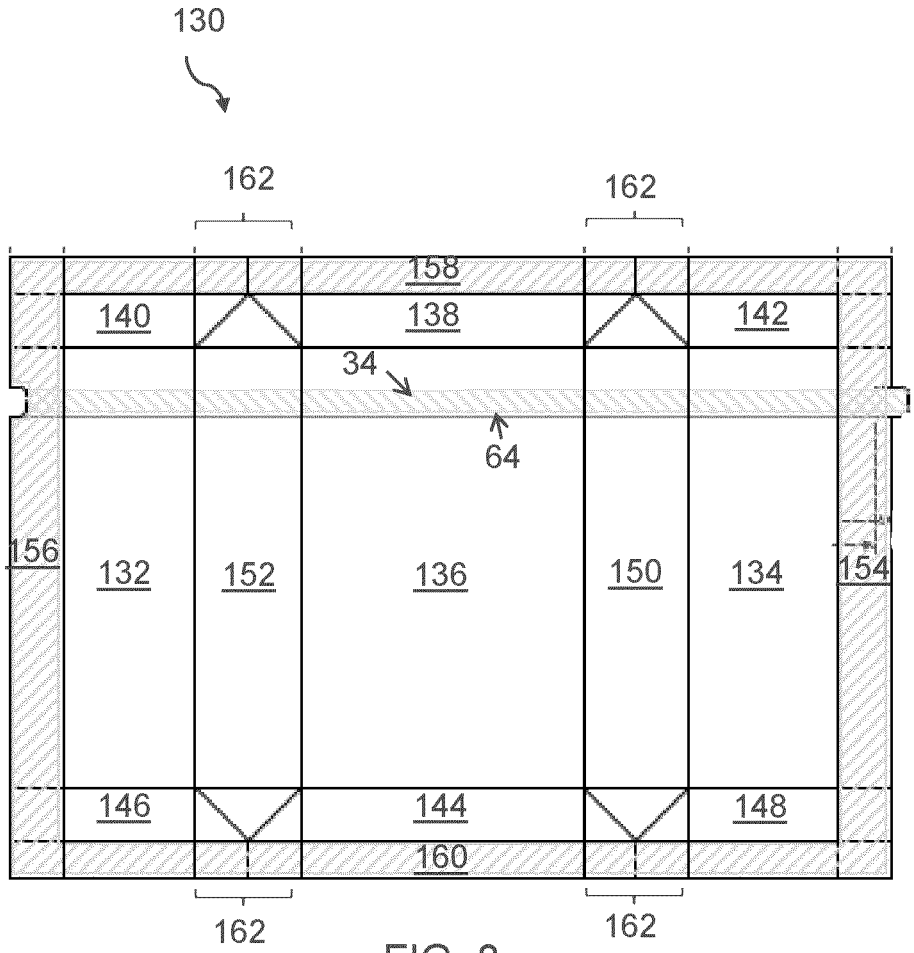
FIG. 8 is a schematic top view of a blank which may be used to form the pouch.

The first side section 96 and the second side section 98 of the frame 92 are shaped such that the lid 16 is not blocked from being moved into the closed position. In particular, the first side section 96 and the second side section 98 have upper edges which slant down (e.g. curve down) from the top edge 100 of the front section 94 of the frame 92. This means that the lid 16 does not impinge on the first side section 96 and the second side section 98 of the frame 92 when being moved into the closed position. Of course, the skilled person will appreciate that the specific shape of the frame 92 illustrated in FIG. 8 is not essential and may be varied. For example, the first side section 96 and the second side section 98 of the frame 92 may have flat upper edges.

The frame 92 may be made from a cellulose-based material, such as paper, hemp, or moulded cellulose pulp. Advantageously, the frame 92 may have a higher rigidity than the pouch 32. For example, the frame 92 may have a density of 130 to 200 grams per square metre.

Figure 3A:
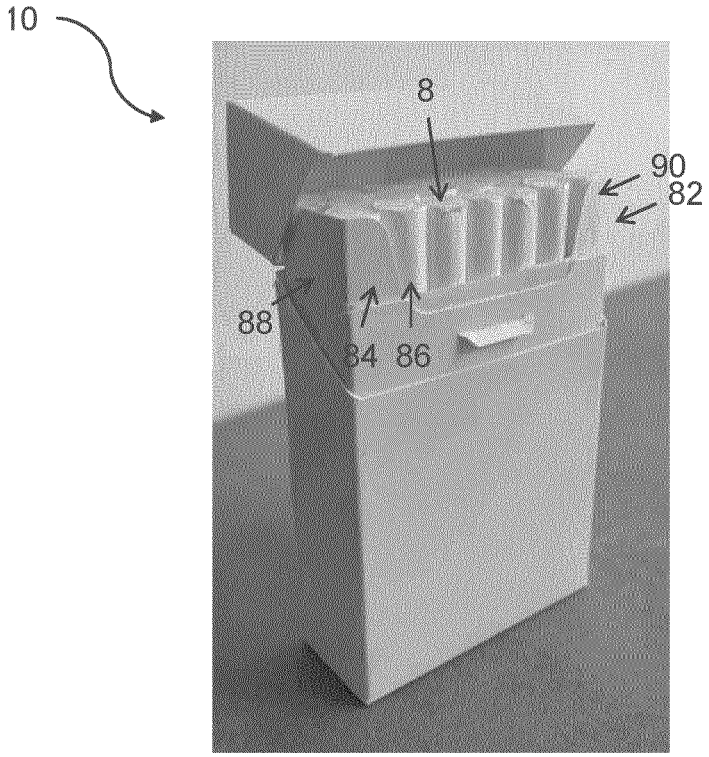
FIG. 3A is a perspective view of the container including the pouch in an opened state and the lid in the open position.
Figure 3B:
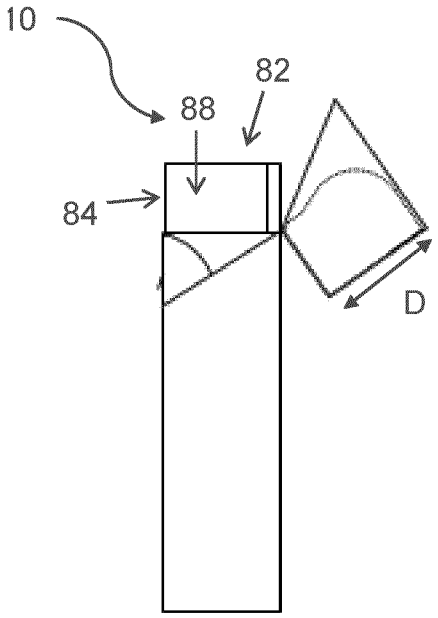
FIG. 3B is a schematic side view of the container including the pouch in the opened state and the lid in the open position.
Figure 3C:
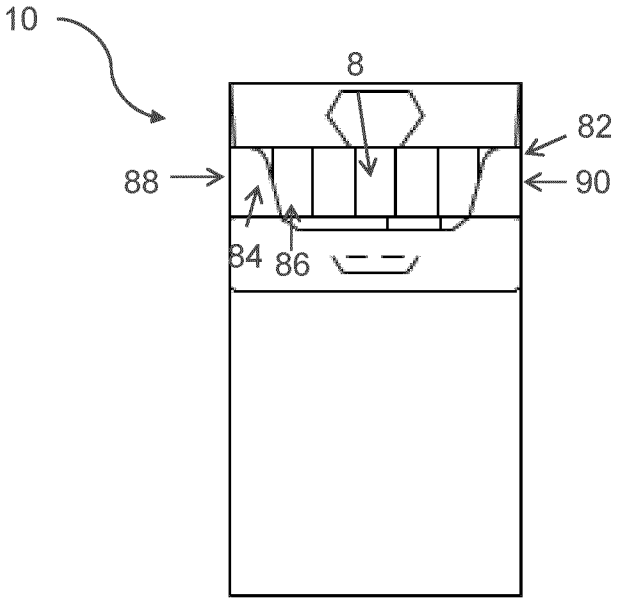
FIG. 3C is a schematic front view of the container including the pouch in the opened state and the lid in the open position.

FIGS. 3A-3C illustrate the pouch 32 in an opened state in which the tear tape 34 has been pulled to remove a top section 38 of the pouch 32 from a bottom section 40 of the pouch 32, thereby exposing the smoking articles 8 contained within the pouch 32. For ease of illustration, reference numerals for features previously labelled in FIGS. 1A-1C have been omitted from FIGS. 3A-3C. A stiffening element 82 is located between the pouch 32 and the smoking articles 8 contained within the pouch 32. The stiffening element 82 is exposed when the pouch 32 is opened.

Figure 7:
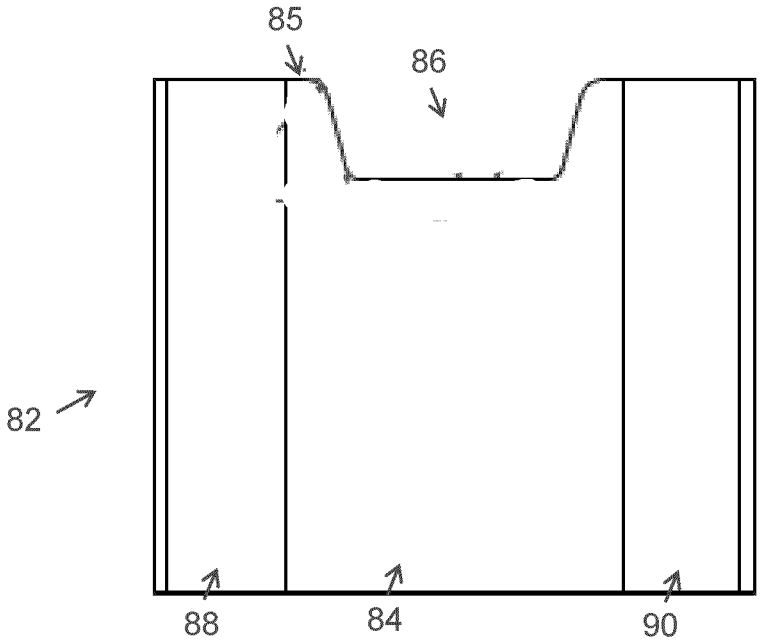
FIG. 7 is a schematic view of a stiffening element of the container in unfolded form.

The stiffening element 82 is a folded element comprising a front section 84, a first side section 88 (e.g. a left side section), and a second side section 90 (e.g. a right side section). FIG. 7 illustrates the stiffening element 82 in unfolded form. The first side section 88 and the second side section 90 are connected to the opposing sides of the front section 84 by respective fold lines. When the container 10 is constructed, the first side section 88 and the second side section 90 are folded approximately 90 degrees about the respective fold lines and the stiffening element 82 is arranged between the pouch 32 and the smoking article 8 such that the front section 84, the first side section 88 and the second side section 90 of the stiffening element 82 are arranged adjacent to (i.e. interface with) the front major portion 110 of the pouch 32, the first side portion 118 of the pouch 32, and the second side portion 120 of the pouch 32 respectively.

Advantageously, the presence of the stiffening element 82 further improves the stiffness of the container 10, thereby further enhancing the protection and support of the smoking articles 8 contained with the pouch 32, whilst ensuring that the tear tape 34 remains accessible to a user.

The height of stiffening element 82, and in particular the height of the first side section 88 and the second side section 90 of the stiffening element 82, is equal to the height of the pouch 32. This arrangement provides optimal protection and support for the smoking articles 8 contained with the pouch 32.

The stiffening element 82 has a top edge 85 in which a cut-out 86 is formed. That is, a portion of material is removed along the top edge 85 of the front section 84 of the stiffening element 82 to form the cut-out 86, which may also be referred to as a recessed portion.

The cut-out 86 extends below the bottom edge 36 of the tear tape 34 and/or the line of weakening 64. In this way, when the tear tape 34 is pulled to open the pouch 32, the smoking articles 8 are additionally exposed through the cut-out 86, allowing a user to easily grasp and remove the smoking articles 8. Preferably, the cut-out 86 extends below the top edge 85 of the stiffening element 82 a distance of 10% to 30% of the height of the front section 84 of the stiffening element 82. For example, the cut-out may extend 10 mm, 11 mm, 12 mm, 13 mm, 14 mm or 15 mm below the top edge 85 of the stiffening element 82.

The cut-out 86 is centrally positioned along the top edge 85 of the front section 84 of the stiffening element 82, thereby providing optimal access to the smoking articles 8. The cut-out 86 may have a width of at least 50% of the width of the front section 84 of the stiffening element 82.

The stiffening element 82 may be made from a cellulose-based material, such as paper, hemp, or moulded cellulose pulp. Advantageously, the stiffening element 82 may have a higher rigidity than the pouch 32. For example, the stiffening element 82 may have a density of 130 to 200 grams per square metre.

The pouch 32 may be formed from a blank 130 comprising the wrapper 122 and the moisture barrier coating 124 (and, in some embodiments, the outer coating 125). The blank 130 is illustrated in FIG. 8.

The blank 130 comprises a plurality of panels 136-152 separated by fold lines. The plurality of panels 136-152 include a first front blank panel 132 and a second front blank panel 134 for cooperatively forming the front major portion 110 of the pouch 32. The plurality of panels 136-152 further include a rear blank panel 136 for forming the rear major portion 112 of the pouch. The plurality of panels 136-152 further include a first top blank panel 138, a second top blank panel 140, and a third top blank panel 142 for cooperatively forming the top minor portion 114 of the pouch 32. The plurality of panels 136-152 further include a first bottom blank panel 144, a second bottom blank panel 146, and a third bottom blank panel 148 for cooperatively forming the bottom minor portion 116 of the pouch 32. The plurality of panels 136-152 further include a first side blank panel 150 and a second side blank panel 152 for forming the first side portion 118 and the second side portion of the pouch 32 respectively.

The blank 130 comprises a first longitudinal fin tab 154 and a second longitudinal fin tab 156, a top transverse fin tab 158, and a bottom transverse fin tab 160 which form the border (i.e. the edge portions) of the blank 130.

The blank 130 (and thus also panels 136-152 and tabs 154-160) may be described as having two surfaces: an exterior surface and an opposed interior surface. When formed, the exterior surface 126 of the pouch 32 corresponds to the exterior surface of the blank 130 and the interior surface 128 of the pouch 32 corresponds to the interior surface of the blank 130. The moisture barrier coating 124 is formed on the interior surface of the blank 130 and the outer coating 125 is optionally formed on the exterior surface of the blank 130.

The tear tape 34 is attached to the interior surface of the blank 130, and extends in a straight line across the second longitudinal fin tab 156, the first front blank panel 132, the second side blank panel 152, the rear blank panel 136, the first side blank panel 150, the second front blank panel 134, and the first longitudinal fin tab 154. Optionally, the tear tape 34 may only extend over one of the first longitudinal fin tab 154 and the second longitudinal fin tab 156. In this way, when the pouch 32 is constructed, only a single layer of the tear tape 34 extends through the first fin seal 104, thereby reducing the bulkiness of the pouch 32.

The line of weakening 64 is formed in the exterior surface of the blank 130, and extends parallel and adjacent to the bottom edge 36 of the tear tape 34, as previously described.

To form the pouch 32 from the blank 130, each of the panels 136-152 and tabs 154-160 are folded about the respective fold lines that connect them with other panels 136-152 and tabs 154-160 of the blank 130. Each of the panels 136-152 and tabs 154-160 are folded about the respective fold lines at approximately 90 degrees. The first longitudinal fin tab 154 is sealed to the second longitudinal fin tab 156 along the interior surface, thereby forming the first fin seal 104. The top transverse fin tab 158 is sealed to itself along the interior surface, thereby forming the second fin seal 106. The bottom transverse fin tab 160 is sealed to itself along the interior surface, thereby forming the third fin seal 108. Each fin seal 104-108 may be sealed using a suitable adhesive.

In the assembled pouch 32, e.g. as illustrated in FIGS. 4A-4C, the first fin seal 104, second fin seal 106 and the third fin seal 108 are typically folded against (e.g. arranged to lie substantially flat against) the front major portion 110, the top minor portion 114, and the bottom minor portion 116 of the pouch 32 respectively. The first fin seal 104 is typically folded against the front major portion 110 prior to sealing of the second fin seal 106 and the third fin seal 108.

The fin seals 104-108 are effective in sealing the pouch 32 from the external environment. The smoking articles 8 may be provided within the pouch 32 before or during the folding and sealing process.

Once the pouch 32 has been formed from the blank 130, the tear tab 35 of the tear tape 34 is arranged to protrude through the first fin seal 104 such that it may be pulled by a user.

Figure 9:
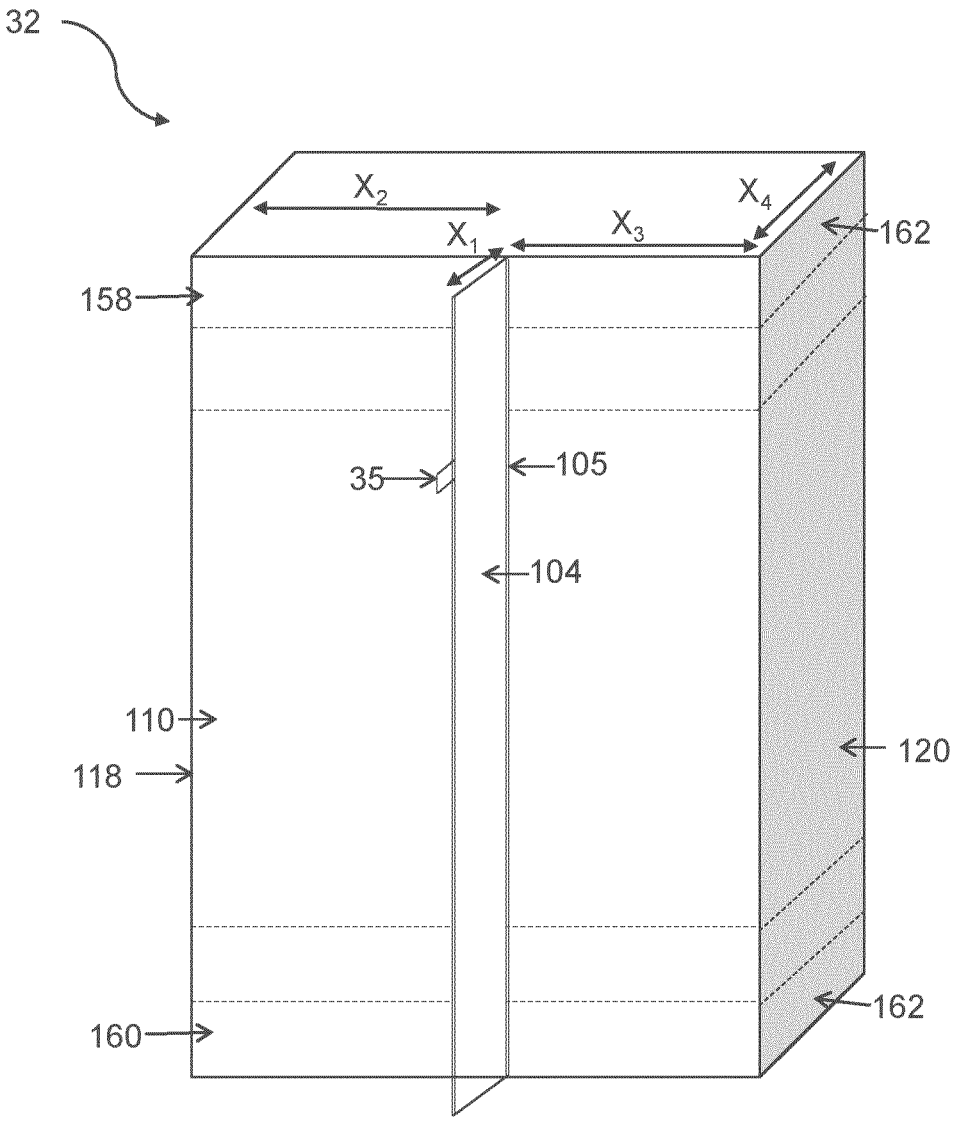
FIG. 9 is a perspective view of a partially constructed form of the pouch in which only the first fin seal has been sealed.

FIG. 9 illustrates a partially constructed form of the pouch 32 in which only the first fin seal 104 has been formed. The first fin seal 104 has a base 105 about which the first fin seal 104 may be pivoted. The base 105 corresponds to the fold lines of the blank 130 connecting the first longitudinal fin tab 154 and the second longitudinal fin tab 156 to the second front blank panel 134 and the first front blank panel 132 respectively. That is, the base 105 is the pivotal axis of the first fin seal 104 which extends along the length of the front major portion 110 of the pouch 32. In the state illustrated, the first fin seal 104 protrudes away from the pouch 32, and has not yet been folded against the front major portion 110 of the pouch 32.

To form the second fin seal 106 and the third fin seal 108, the top transverse fin tab 158 is sealed to itself along its interior surface and the bottom transverse fin tab 160 is sealed to itself along its interior surface.

The top transverse fin tab 158 and the bottom transverse fin tab 160 each comprise side segments 162. Due to geometrical constraints, and in order to prevent any material protruding from the second fin seal 106 and the third fin seal 108, the side segments 162 are tucked into the second fin seal 106 and the third fin seal 108 respectively and sealed therein. That is, the side segments 162 are folded, e.g. in a concertina arrangement, and sealed between the interior surfaces of the top transverse fin tab 158 and the bottom transverse fin tab 160 respectively, as illustrated in FIG. 10.

Figure 10:
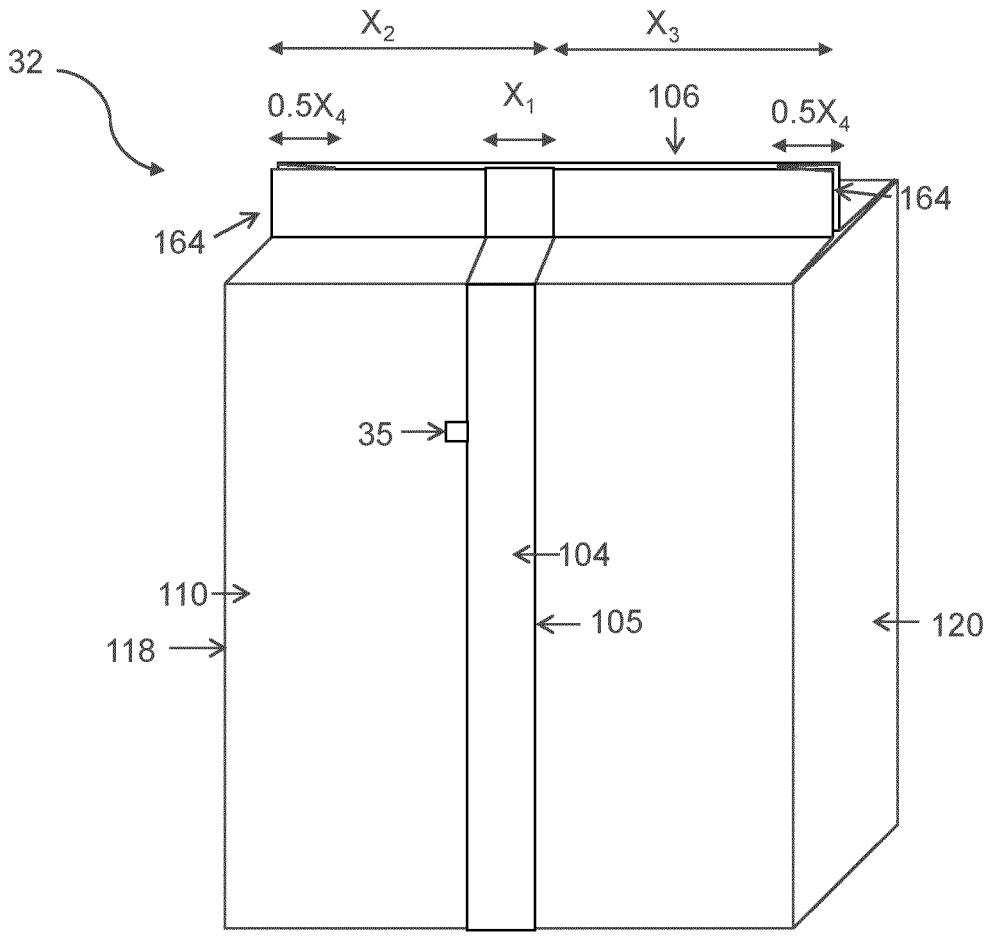
FIG. 10 is a perspective view of the pouch illustrating the first fin seal and the second fin seal which have been sealed.

In particular, FIG. 10 illustrates the pouch 32 in a state wherein the first fin seal 104 has been sealed and folded against the front major portion 110 of the pouch 32, and the second fin seal 106 has been subsequently formed and sealed. For ease of illustration, the third fin seal 108 is not shown in FIG. 10, but the skilled person will understand that the third fin seal 108 is similarly configured to the second fin seal 106 *Mutatis mutandis.*

As a consequence of folding and interposing the side segments 162 within the second fin seal 106, two bulky regions 164 are formed adjacent the first side portion 118 and the second side portion 120 of the pouch 32 respectively. The bulky regions 164 consist of four layers of the wrapper 122. In contrast, away from the first side portion 118 and the second side portion 120, i.e. towards the centre of the second fin seal 106, only two layers of the wrapper 122 are present along the second fin seal 106.

The first fin seal 104 is arranged such that the first fin seal 104 does not overlap with either of the bulky regions 164, i.e. the first fin seal 104 does not overlap with the regions of the second fin seal 106 in which the side segments 162 are present. In other words, the first fin seal 104 is sized and positioned such that, when the first fin seal 104 is folded against the front major portion 110 of the pouch 132, the first fin seal 104 only overlaps with two layers of the wrapper 122 of the second fin seal 106 (i.e. two layers of the top transverse fin tab 158). The first fin seal 104 does not overlap with the side segments 164.

The first fin seal 104 is folded towards the first side portion 118 of the pouch 32. The skilled person will appreciate that, as the side segments 162 are folded at their midpoint before being sealed within the second fin seal 106, the length of each bulky region 164 is equal to half the width $X_4$ of the first side portion 118 (or second side portion 120) of the pouch 32. Hence, to ensure that overlap with the bulky regions 164 is avoided, the first fin seal 104 is configured such that the distance $X_2$ between the base 105 of the first fin seal 104 and the first side portion 118 of the pouch 32 is equal to or greater than the sum of the width $X_1$ of the first fin seal 104 and half the width $X_4$ of the first side portion 118 of the pouch 32. Additionally, the distance $X_3$ between the base 105 of the first fin seal 104 and the second side portion 120 of the pouch 32 is equal to or greater than half the width $X_4$ of the second side portion 120 of the pouch 32. That is, $X_1+0.5X_4 \leq X_2$ and $0.5X_4 \leq X_3$.

Advantageously, by arranging the first fin seal 104 such that overlap with more than two layers of the wrapper 122 along the second fin seal 106 is avoided, the bulkiness of the pouch 32 is reduced and the seal quality of the second fin seal 106 is improved. In particular, when the second fin seal 106 is sealed, the wrapper 122 is squeezed and compressed along the length of the second fin seal 106. Hence, if the first fin seal 104 overlaps with the bulky region 164 when the first fin seal 104 is folded against the pouch 32, six layers of the wrapper 122 would be squeezed and compressed at the bulky region 164, thereby resulting in a poor quality seal of the second fin seal 106. Hence, by avoiding overlap between the first fin seal 104 and the bulky regions 164, and ensuring that there are a maximum of four overlapping layers of wrapper 122 at all locations along the second fin seal 106, the seal quality of the second fin seal 106 is significantly improved. Similar comments apply with respect to the third fin seal 106 *mutatis mutandis*.

The invention claimed is:

1. A package for collating a plurality of smoking articles, comprising:

a substantially cuboidal pouch comprising: a front major portion; a rear major portion; a top minor portion; a bottom minor portion; a first side portion; and a second side portion, wherein the pouch is made from material configured and sealed to prevent the ingress of moisture into the pouch, wherein the pouch is formed from a wrapper that is folded and sealed by:

a first fin seal extending along a length of the front major portion; a second fin seal extending along a length of the top minor portion; and a third fin seal extending along a length of the bottom minor portion, wherein the first fin seal is folded to overlap with each of the second fin seal and the third fin seal, and wherein the first fin seal is arranged at a distance from each side portion such that, at each overlap with the second fin seal and the third fin seal, the first fin seal only overlaps with two other layers of the wrapper; and wherein the package further comprises a tear tape attached to the pouch and extending along the front major portion, the first side portion, the rear major portion, and the second side portion in a transverse direction with respect to a length of the pouch, wherein a line of weakening is formed in the pouch parallel to the tear tape such that the pouch is configured to be at least partially opened along the line of weakening when the tear tape is pulled by a user.

2. The package of claim 1, wherein the tear tape is attached to an internal surface of the pouch and extends through the first fin seal to expose a tear tab to be pulled by a user.

3. The package of claim 1, wherein the first fin seal is folded towards the first side portion, wherein a distance between a base of the first fin seal and the first side portion is equal to or greater than the sum of a width of the first fin seal and half a width of the first side portion, and wherein a distance between the base of the first fin seal and the second side portion is equal to or greater than half a width of the second side portion.

4. The package of claim 1, wherein the wrapper is a cellulose-based wrapper, and wherein the pouch further comprises a moisture barrier coating formed on the wrapper.

5. The package of claim 4, wherein the moisture barrier coating is a water-based lacquer or a heat sealable coating.

6. The package of claim 4, wherein the line of weakening is formed in an external surface of the pouch, and wherein the moisture barrier coating is formed on an internal surface of the pouch.

7. The package of claim 1, wherein the line of weakening partially extends through the wrapper.

8. The package of claim 1, further comprising a stiffening element disposed within the pouch and arranged to lie substantially flush against an internal surface of the pouch.

9. The package of claim 8, wherein the stiffening element is a folded element having a front section, a first side section, and a second side section, wherein the front section, the first side section, and the second side section are arranged to interface with the front major portion, the first side portion, and the second side portion of the pouch respectively, and wherein the first and second side sections each has a length equal to a length of the pouch.

10. The package of claim 9, wherein the front section of the stiffening element has a cut-out in a top edge thereof, and wherein the cut-out extends down to at least level with the line of weakening.

11. The package of claim 10, wherein the cut-out extends a distance below the line of weakening.

12. The package of claim 10, wherein the cut-out has a width of at least 50% of a width of the front section and a length of between 10 to 20% of a length of the front section of the stiffening element.

13. The package of claim 1, wherein the tear tape comprises a cellulose-based material.

14. A container for smoking articles, comprising:

an outer casing having a lid moveable between an open position and a closed position; and the package according to claim 1, wherein the package is housed within the outer casing.

15. A system comprising:

the package according to claim 1; and a plurality of smoking articles contained within the pouch.

16. A system comprising:

the container according to claim 14; and a plurality of smoking articles contained within the pouch.

17. The package of claim 8, wherein the stiffening element comprises cellulose-based material.

* * * * *